US005169826A

United States Patent [19]

Seitz et al.

[11] Patent Number: 5,169,826

[45] Date of Patent: Dec. 8, 1992

[54] CF INK AND TANDEM PRINTING PROCESS

[75] Inventors: Michael E. Seitz, Miamisburg; Frank V. Parenti, Kettering, both of Ohio

[73] Assignee: The Standard Register Company, Dayton, Ohio

[21] Appl. No.: 604,808

[22] Filed: Oct. 26, 1990

[51] Int. Cl.[5] ..... B41M 5/132

[52] U.S. Cl. ..... 503/207; 503/213; 503/214; 503/225

[58] Field of Search ..... 427/150, 152; 503/213-215, 207, 225, 209; 106/21

[56] References Cited

U.S. PATENT DOCUMENTS 3,466,184 9/1969 Bowler et al. ..... 117/36.2
3,466,185 9/1969 Taylor ..... 117/36.2
3,672,935 6/1972 Miller et al. ..... 117/36.8
4,063,754 12/1977 Shackle et al. ..... 282/27.5
4,263,047 4/1981 Miyamoto et al. ..... 106/21
4,337,968 7/1982 Maierson ..... 282/27.5
4,416,471 11/1983 Yamato et al. ..... 282/27.5
4,422,670 12/1983 Hasegawa et al. ..... 282/27.5

*Primary Examiner*—B. Hamilton Hess
*Attorney, Agent, or Firm*—Killworth, Gottman, Hagan & Schaeff

[57] ABSTRACT

A CF ink and process which can be applied to a support sheet by standard transfer-litho press is provided. The nonvolatile printing ink which is capable of color development may be used to produce a CF carbonless copy sheet, or, in combination with a high solids, aqueous-based CB ink, to produce a CFB carbonless copy sheet. The ink includes from about 25 to 35% of a non-volatile oil, 25 to 35% of an acidic color developer, 20 to 50% filler, and 4 to 15% dispersed wax particles, all percantages by weight.

10 Claims, 1 Drawing Sheet

CF INK AND TANDEM PRINTING PROCESS

CROSS REFERENCE TO RELATED APPLICATIONS

Reference is made to copending application Ser. No. 413,995, filed Sep. 29, 1989, and entitled "High Solids CF Printing Ink", the disclosure of which is hereby incorporated by reference, now U.S. Pat. No. 5,084,497.

FIELD OF THE INVENTION

The present invention relates to a non-volatile, filled, printing ink capable of color development (CF ink), to a process for the production of carbonless copy paper printed with such ink, and to the carbonless copy paper so produced. The present invention also relates to a process for printing in tandem on a paper substrate such a CF ink and a microencapsulated CB ink in the production of carbonless copy paper.

BACKGROUND OF THE INVENTION

In the manufacture of pressure-sensitive recording papers, better known as carbonless copy papers, a layer of pressure-rupturable microcapsules containing a solution of colorless dyestuff precursor is normally coated on the back side of the front sheet of paper of a carbonless copy paper set. This coated backside is known as the CB coating. In order to develop an image or copy, the CB coating must be mated with a paper containing a coating of a suitable color developer, also known as dyestuff acceptor, on its front. This coated front color developer coating is called the CF coating. The color developer is a material, usually acidic, capable of forming the color of the dyestuff by reaction with the dyestuff precursor.

Marking of the pressure-sensitive recording papers is effected by rupturing the capsules in the CB coating by means of pressure to cause the dyestuff precursor solution to be exuded onto the front of the mated sheet below it. The colorless or slightly colored dyestuff, or dyestuff precursor, then reacts with the color developer in the areas at which pressure was applied, thereby effecting the colored marking. Such mechanism for the technique of producing pressure-sensitive recording papers is well known.

Among the well known basic, reactive, colorless chromogenic dye precursors used for developing colored marks when applied to a receiving sheet are such color developers as Crystal Violet Lactone, the p-toluenesulfonate salt of Michler's Hydrol or 4,4'-bis(diethylamino) benzhydrol, Benzoyl Leuco Methylene Blue, Indolyl Red, Malachite Green Lactone, spiro phthalide xanthenes such as 6''-(diethylamino)-3''-methyl-2''-(phenylamino)spiro[isobenzofuran-1(3H),9''-[9H]xanthen]-3-one, Rhodamine Lactone, and mixtures thereof.

Among well known color developers used on CF sheets are activated clays, zinc salicylate, and phenolic-type resins, such as acetylated phenolic resins, salicylic acid modified phenolics and particularly, novolac-type phenolic resins.

Various CF coatings and formulations have been used and various methods of applying the CF coating have been tried in the prior art. Aqueous CF coating compositions have been widely used, as for example in U.S. Pat. No. 3,672,935. However, when aqueous coatings are used, a large amount of water must then be evaporated, requiring large expensive dryers. Additional equipment must also be added to the coater to prevent sheet distortion, curl or cockle. The result is a coater and accompanying facilities which are expensive to build and operate.

It is also known that acidic color developer, such as phenolic resin, can be applied to the paper substrate as a solution in a volatile organic solvent which, after application, evaporates completely leaving a thin film of solid resin on the paper. This method is taught in U.S. Pat. Nos. 3,466,184 and 3,466,185. These coatings have several problems. Consistency of the solid solutions and the use of volatile solvents give rise to printing problems and cause swelling of rubber plates and rolls. They also have high energy requirements and present potential environmental contamination problems.

Because of these problems, the application of CF coatings is a costly and complicated operation if done separately. Most manufacturers coat the CF coating on the paper while the web is still on the paper machine to reduce the cost. Unfortunately, since most paper mills require large minimum orders, this approach is limited to high volume paper weights. A small user's volume is frequently too low to take advantage of this option.

A more economical approach, from the business forms manufacturer's perspective, is the application of the CF coating on the press with the rest of the printing and form preparation operations. Application of the CF coating as an ink would require no special equipment. Attempts have been made to develop such a system in order to take advantage of its benefits.

Maierson, U.S. Pat. No. 4,337,968, teaches dissolving a phenolic resin in ink along with modifiers to achieve the proper rheology. This type of CF ink solved the coating and economic disadvantages associated with volatile solvents and aqueous CF coatings. The CF ink could be applied by the standard business forms press on any paper stock with no modification and no sheet distortion.

While this represented a significant improvement over prior organic solvent based vehicles, the CF ink dried by adsorption and migrated into the sheet. The loss of color developer from the front surface of the sheet caused by the migration of the ink reduced the imaging ability of the coated sheet and also produced discoloration problems when placed in contact with CB coatings which typically contained about 5% free dye solution.

Special CB coatings that bind or trap the free dye solution were developed to overcome the discoloration problems. One example of this is Shackle et al, U.S. Pat. No. 4,063,754. In this coating, the capsules are produced in an aqueous vehicle and then flushed onto a wax vehicle, with evaporation of the water to produce a 100% solids, hot melt CB coating. The wax vehicle is selected so that any free dye solution will be bound up in the wax matrix.

However, this approach is believed to be undesirable both from an aesthetic and an economic standpoint. Waxcontaining coatings made in this way have a greasy, slick feeling to the touch. Moreover, to obtain an image density equivalent to that of an aqueous coating, a 100% solids coating must supply the same number of capsules as an aqueous coating.

Since approximately 60% of the solids, by weight, are inert vehicle components required for coatability, the hot melt coat weights are 2.5 (i.e., 1/0.4) times higher than the aqueous or solvent-based coatings. The additional solids merely add to the material cost of the CB coating. Further, there are additional processing costs associated with 100% solids coatings including energy costs for removing the water, equipment costs for the flushing and evaporation steps, and equipment and energy costs for the hot melt coater.

Accordingly, there remains a need for a non-volatile CF ink that can be press applied and which does not migrate into the paper stock after application obviating the need for special hot melt CB coatings.

SUMMARY OF THE INVENTION

The present invention meets this need by providing a CF ink and process which can be applied to a support sheet by standard transfer-litho press. The non-volatile, filled, printing ink capable of color development may be used to produce a CF carbonless copy sheet, or, in combination with a high solids, aqueous-based CB ink, to produce a CFB carbonless copy sheet.

In accordance with one aspect of the present invention, a printing ink capable of color development is provided which includes from about 25 to 35% of a non-volatile oil, 25 to 35% of an acidic color developer, 20 to 50% filler, and 4 to 15% dispersed wax particles, all percentages by weight.

The nonvolatile oil is a high boiling point oil, preferably having an initial boiling point of >270° C. and a flash point of >125° C. such as Magiesol® 60, available from Magie Bros. Oil Co. The oil should comprise nearly 100% saturates, i.e., should contain only trace amounts of aromatics or olefins. Further, the preferred oils are normal paraffinic hydrocarbons; however, branched and cyclic hydrocarbons may also be used.

The acidic color developer may be any of those compositions used in the prior art including activated clays, zinc salicylate, and phenolic resins such as acetylated phenolic resins, salicylic acid modified phenolic resins, and particularly novolac-type phenolic resins. The color developer is soluble in the nonvolatile oil and is capable of reacting with a dyestuff precursor to develop a colored complex.

The filler is preferably in the form of small particles or aggregates having sizes in the range of from about 0.03 to 1.5μ. The filler is preferably selected from the group consisting of metal oxides, metal hydroxides, metal carbonates, and compatible mixtures thereof. The filler particles act to adsorb at least a portion of the nonvolatile oil and color developer on the surfaces thereof.

The ink also contains wax particles dispersed in, or recrystallized from, the oil-color developer solution which preferably range in size from 0.1 to 15μ. One component of the dispersed wax is preferably a low melting point wax such as a paraffin having a melting point of between about 60° to 70° C. A second wax having a higher melting point in the range of between about 70° to 110° C. may also be included in the ink. Examples of suitable higher boiling point waxes include micronized polyethylene, microcrystalline waxes, or other petroleum waxes. The initial softening point of the waxes should be between 60° and 100° C. The concentration of the wax in the ink should be between 4 and 15% by weight. The wax component of the composition acts to fix the ink to the surface of the support sheet as explained in greater detail below.

The present invention also provides a CF carbonless copy sheet comprising a support sheet and a coating thereon, the coating comprising a printing ink capable of color development comprising, by weight, about 25 to 35% of a non-volatile oil, 25 to 35% of an acidic color developer, 20 to 50% filler, and 4 to 15% dispersed wax.

In another embodiment of the invention, a CFB two-side coated carbonless copy sheet is provided which includes a support sheet having two major surfaces. The coating on the first surface thereof comprises a printing ink capable of color development comprising, by weight, about 25 to 35% of a non-volatile oil, 25 to 35% of an acidic color developer, 20 to 50% filler, and 4 to 15% dispersed wax. The coating on the second surface thereof comprises a non-volatile diluent selected from the group consisting of methyl glucoside, dimethyl urea, dimethyl hydantoin formaldehyde resin, sorbitol, erythritol, polyoxyethylene polyols, and compatible mixtures thereof and microcapsules containing a dyestuff precursor.

The present invention also provides a process for the production of a carbonless copy sheet including the steps of applying a printing ink capable of color development comprising, by weight, from about 25 to 35% of a non-volatile oil, 25 to 35% of an acidic color developer, 20 to 50% filler, and 4 to 15% dispersed wax particles onto a first surface of a support sheet. A high solids, aqueous-based dyestuff precursor encapsulated printing ink is applied onto the opposite surface of the support sheet. The support sheet is then heated sufficiently to melt the dispersed wax particles in the color developer printing ink and to evaporate excess water from the high solids encapsulated printing ink. The support sheet is then allowed to cool to solidify the color developer printing ink and fix it on the first surface of the support sheet.

In a preferred embodiment of the invention, the surface containing the printing ink capable of color development is heated to between about 77° to 135° C., and the surface containing the high solids encapsulated printing ink is heated to between about 50° to 77° C. The time between the application of the high solids encapsulated printing ink and the heating of the support sheet should be sufficient to permit the encapsulated ink to penetrate the surface of the support sheet, and is preferably at least 0.15 seconds. The first surface of the support sheet is heated for a time sufficient to permit fusing of the CF ink to the support sheet and the evaporation of excess water from the CB ink. Preferably, the support sheet is heated for at least 0.05 seconds.

The CF ink can be immobilized (fused) on the surface of the support sheet by using a low energy/low temperature dryer which is preferably a drum dryer containing one or more heated rolls. If the preferred CB coating is used with the CF ink, then both coatings can be immobilized at the same time in the same dryer. The one or more heated drying rolls are preferably heated to a temperature of between about 77° to 135° C.

Accordingly, it is an object of the present invention to provide a non-volatile, filled, printing ink capable of color development which can be press applied, and a carbonless copy sheet coated with such an ink. It is a further object of the present invention to provide a carbonless copy sheet coated on one side with such an ink and coated on the other side with a CB ink. It is a further object of the present invention to provide a process for producing a carbonless copy sheet utilizing such an ink. These and other objects of the present invention will become apparent to those skilled in the art from a reading of the following detailed description of the preferred embodiments, the accompanying drawing, and the appended claims.

BRIEF DESCRIPTION OF THE DRAWING

The single drawing figure.

DETAILED DESCRIPTION OF THE PREFERRED EMBODIMENTS

Figure 1:
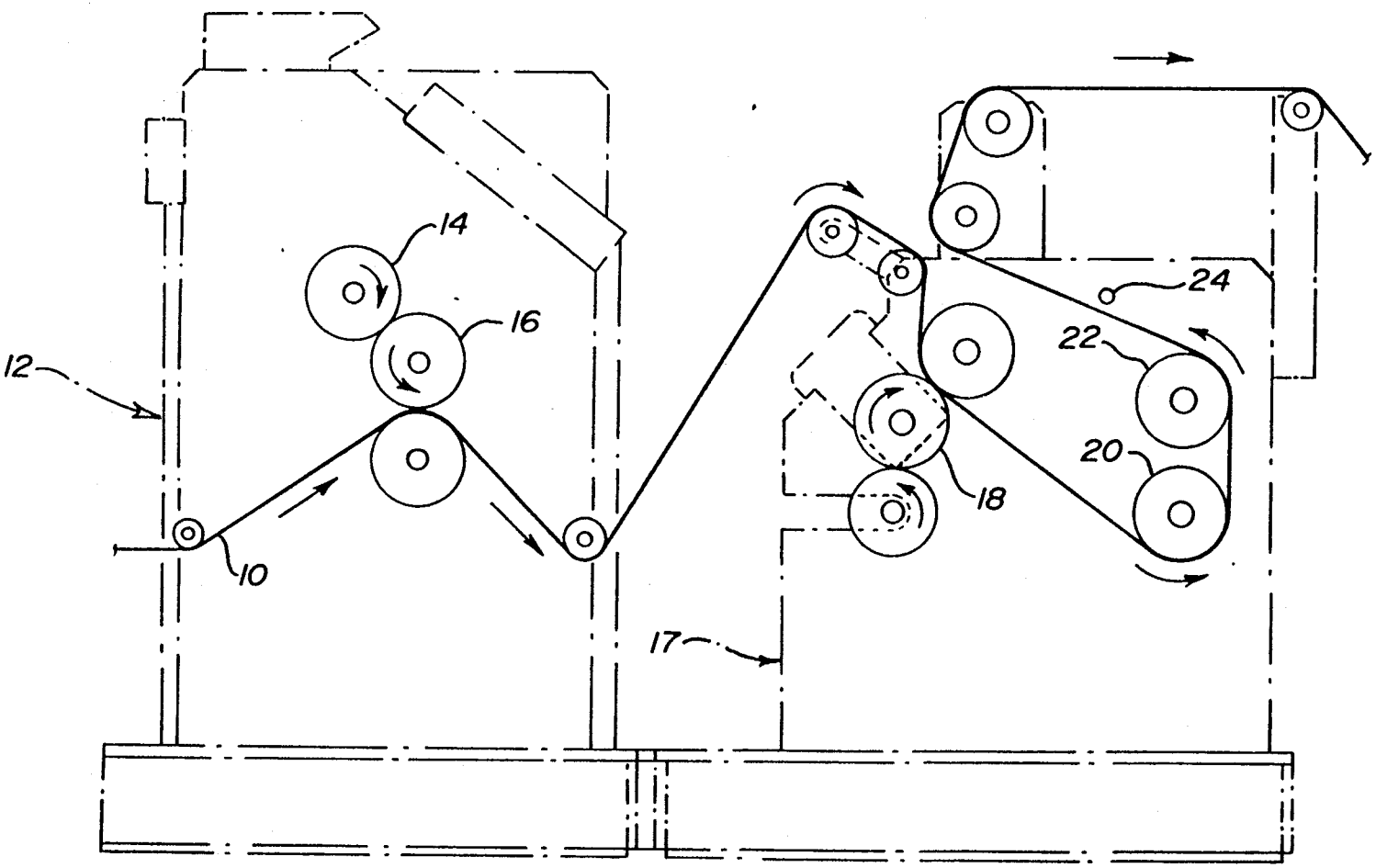
FIG. 1, illustrates schematically the process for producing a carbonless copy sheet in accordance with the present invention.

The CF ink of the present invention may be used to prepare CF or CFB carbonless copy sheets using standard printing techniques. An important aspect of the present invention is the incorporation of a filler material, for the adsorption of at least a portion of the color developer-oil solution, and a dispersed wax, for fixing the color developer to the support sheet, in the CF printing ink. The inks are preferably printed onto a continuous web of a supporting substrate, typically a paper web. The inks may be applied to the entire surface of the supporting substrate, or may be spot printed onto predetermined areas of the substrate.

The present invention also makes use of a non-volatile oil into which the color developer is dissolved, rather than the aqueous or volatile organic vehicles used by some prior art inks. The nonvolatile oil is a high boiling point oil, preferably having an initial boiling point of >270° C. and a flash point of >125° C. such as Magiesol ® 60, available from Magie Bros. Oil Co. The oil should comprise nearly 100% saturates, i.e., should contain only trace amounts of aromatics or olefins. Further, the preferred oils are normal paraffinic hydrocarbons; however, branched and cyclic hydrocarbons may also be used. The non-volatile oil is present in the ink in an amount of from about 25–35%, by weight (30–43%, by volume).

The acidic color developer may be any of those compositions used in the prior art including activated clays, zinc salicylate, and phenolic resins such as acetylated phenolic resins, salicylic acid modified phenolic resins, and particularly novolac-type phenolic resins. The color developer is capable of developing color in a color former, such as a dyestuff precursor. The color developer is soluble in the non-volatile oil. Suitable color developer compositions include a novolac phenolic resin available from Schnectady Chemicals under the designation HRJ 10138. The color developer composition is preferably present in the ink in an amount of from about 25–35%, by weight (30–43%, by volume).

As previously discussed, the presence of a filler material in the ink is also important. The filler may be added to the color developer/oil solution as the ink is prepared. The primary particle sizes of the filler material can vary between about 0.03 and 1.5μ. The preferred particle sizes achieved after dispersing them in the ink are from about 0.1 to 1.5μ. These sizes insure that as the ink is printed onto the support sheet, which is preferably paper, the filler particles will remain on the surface of the sheet rather than penetrating into the pores. These fillers can be present in the ink at 20 to 50% by weight, 10 to 23% by volume.

The preferred fillers are metal oxides, hydroxides, and carbonates. The term metal as it is used herein encompasses alkaline earth metals. The amphoteric or slightly alkaline surface of the filler materials promotes adsorption of the acidic color developer. Examples of suitable filler materials are titanium dioxide, zinc oxide, alumina trihydrate, calcium carbonate, antimonious oxide, and magnesium carbonate.

The filler particles will typically adsorb about 25% of their weight in the color developer/oil solution. The size of the filler particles prevents them from penetrating into the sheet. Therefore, the filler particles act to concentrate the color developer at or near the surface of the support sheet and provide better performance. In addition, the lower free oil content of the ink, due to adsorption by the filler particles, reduces the oil saturation of the sheet, resulting in a more favorable equilibrium between the diffusion and adsorption forces. The reduced ink migration reduces the discoloration of the sheet and improves the shelf life of the product.

A dispersed wax is also incorporated into the ink to reduce ink migration even more by fixing the color developer on the surface of the support sheet. The amounts of wax dispersed in the non-volatile oil vehicle, 4–15%, by weight, only raises the viscosity of the ink slightly. In a preferred embodiment, a mixture of different waxes is used.

A low melting point wax, preferably paraffin having a melting point of from 60° to70° C., is dissolved in the ink during manufacture. The ink is then drained hot into a container. The wax is then slowly cooled, creating a flocculated structure as the paraffin slowly crystallizes in the ink. This shortens the ink enough to reduce ink penetration on the support sheet that would otherwise occur prior to the fusion step. Higher melting point waxes, in the 70° to 110° C. range, are dispersed in the ink as micron size particles at a temperature well below their melting point. Micronized polyethylene, microcrystalline waxes, and other petroleum waxes are preferred, but small amounts of vegetable waxes may also be used.

Wax has several characteristics which make it suitable for this use: sharp melting point, low melt viscosity, and low tack. Low tack is important because the CF ink is in direct contact with dryer rolls after it is printed onto the support sheet. Other thermoplastic materials can stick to the heated dryer rolls, causing ink buildup or tracking.

A homogeneous solution is formed when the dispersion is heated to melt the wax. When the solution cools, the wax solidifies and recrystallizes, trapping oil within. Slower cooling rates yield larger crystal growth and less thickening. If the cooling rate is rapid, a thick non-flowable gel will be produced. After dispersing or slowly recrystallizing the wax in the ink, the heated rolls can be used to melt the wax which will solidify the CF ink as it quickly cools.

The CF ink of the present invention may be used in combination with a CB ink printed onto the opposite side of the support sheet to form a CFB carbonless copy sheet. The CB ink should have a low oil content to prevent image spread and loss of image resolution. The total amount of dyestuff precursor should preferably be the same as in a conventional CB coating in order to maintain the same image intensity. The dyestuff precursor should also be finely distributed when printed onto the support sheet to achieve good image resolution. These factors require a CB ink having a large number of microcapsules (60–90%, by weight based on solids) containing a high dyestuff precursor content.

The high solids content CB ink described in Seitz, U.S. Pat. No. 4,889,877, contains microcapsules having a high dye/low oil core, a binder blend that desensitizes or strongly binds free dye, and a non-volatile diluent which is suitable for use in the present invention. The CB ink may be applied by an offset gravure press at a low coat weight without support sheet distortion. The encapsulated dyestuff precursor in the CB ink contains about 10-20% dye relative to solvent. The ink can be made in the manner taught in the aforementioned U.S. Pat. No. 4,889,877, the disclosure of which is incorporated by reference.

The CB ink as used in the practice of the present invention will preferably contain the following ingredients: 38% water, 16% non-volatile diluent, 36% oil containing microcapsules of dyestuff precursor, 6% protective colloid, and 15% binder emulsion or alkali soluble resin.

A CB ink made with the preferred composition has a 58% microcapsule loading, by dry weight. Higher capsule loading will improve the performance and efficiency of the CB ink. To increase the effective microcapsule concentration at the surface of the support sheet, the non-volatile diluent in the CB ink is caused to penetrate into the preferred paper support sheet before the CB ink is immobilized on the support sheet by drying.

This immobilization is preferably done using heated drying rolls in a low temperature/energy dryer. In addition to providing a preferred slow, uniform drying rate, the small size of the rolls compared to an oven gives a large degree of freedom in the placement of the rolls. The distance between the drying rolls and the coating station should be such that the open time (the time that the wet CB ink is on the web, which equals the distance between the drying rolls and the printing station divided by the speed of the press) is at least 0.15 seconds, and the drying interval (the distance between the first and last drying rolls divided by the speed of the press) is at least 0.05 seconds. This allows the CB ink to remain fluid long enough for adequate penetration of the non-volatile diluent component of the ink.

The temperature of the heated drying rolls is preferably between about 77° to 135° C. The temperature of the CF side of the support sheet, which is the side in contact with the rolls, will also be in this range. The temperature of the CB side of the support sheet should be between about 50° to 77° C. These temperatures insure the fusing of the CF ink and the evaporation of the excess water from the CB ink without changing the initial moisture content of the support sheet. Only a modest stream of forced air is required to remove the moisture evaporated during drying. Sheet distortion and excessive loss of bound moisture in the CB coating are avoided.

Another advantage of the simultaneous setting of the CF and CB inks is reduced CF ink penetration into the support sheet. The moisture present in the sheet at the time of CF ink fusion inhibits the oily CF ink from excessively penetrating the preferred paper support sheet while heated by drying rolls. The incompatibility and poor wettability of the oily CF ink and the moist CB ink are also useful in discouraging blocking on the dryer roll.

Other drying techniques can be substituted for the rolls if the inks are gradually dried over the same time interval, and the temperature of both sides of the support web or sheet are maintained as above.

The process of the present invention is illustrated schematically in FIG. 1. There, a continuous web of paper 10 is passed through a first printing station 12 where the CF ink is printed onto a first surface of the web by conventional printing equipment such as transfer lithography through print rolls 14 and 16. Where a CB ink is also desired, it is printed onto the opposite surface of web 10 at a second printing station 17, again by using conventional printing equipment such as an offset gravure roll 18.

Web 10, now coated both front and back, is then dried by passing the web over a pair of heated drying rolls 20 and 22 which are maintained at a temperature of between about 77° to 135° C. At these temperatures, the CF ink is fused to the web surface in direct contact with rolls 20 and 22 while excess moisture is evaporated from the CB ink on the opposite side of web 10. The moisture evaporated from the CB side of the web may be removed by an air bar 24 positioned downstream from heated rolls 20 and 22 which blows air over the surface of the web. The spacing between rolls 20 and 22 may be controlled and/or adjusted to provide an optimum drying interval as described above.

In order that the invention may be more readily understood, reference is made to the following examples, which are intended to be illustrative of the invention, but are not intended to be limiting in scope.

EXAMPLE 1

A CF ink was made in accordance with the present invention using the following ingredients, all parts reported by weight.

| | Parts |
|---|---|
| Magiesol 60[1] | 29.69 |
| HRJ 10138[2] | 31.69 |
| Tri Pure R900[3] | 23.65 |
| Hydrol 710[4] | 7.88 |
| Boler 1328[5] | 3.55 |
| Neptune INI[6] | 2.38 |
| Neptune 35223[7] | 1.17 |

[1]Technical white oil from Magie Bros. Oil Co.
[2]Phenolic resin from Schenectady Chemicals, Inc.
[3]Titanium dioxide from E. I. duPont De Nemours & Co.
[4]$Al(OH)_3$ from Alcoa Chemical Division.
[5]Paraffin (60° C.) from Boler Petroleum Co.
[6]Micronized polyethylene from Shamrock Chemical Corp.
[7]Micronized wax, from Shamrock Chemical Corp.

To a container equipped with a high speed mixer/impeller, the Magiesol 60 oil was added, and the oil heated to a temperature of 100°-105° C. The HRJ 10138 phenolic resin flakes were then added to the oil over a period of about 1 hour with moderate stirring. The resin flakes should be added slowly to avoid clumping of the flakes.

After the resin dissolved, heat was removed and the titanium dioxide, Tri Pure R900, was added. Mixing speed was increased to approximately 6,000rpm. While maintaining the high shear mixing speed, the aluminum trihydrate was added. Mixing was continued for approximately 1 hour, during which time the mixture should be permitted to cool to about 50°-60° C.

When an adequate dispersion was achieved, as evidenced by an average particle size of $\leqq 1.0\mu$, the temperature of the mixture was adjusted to 70° C. The Boler 1328 paraffin wax was then added and dissolved. This was followed by addition and dispersion of the Neptune micronized waxes over a period of approximately 20 minutes. The temperature should be kept below about 75°-80° C. as the micronized waxes may dissolve if this temperature is exceeded; it is not desired to dissolve those waxes. Once the micronized waxes were dispersed, the ink was drained through a $150\mu$ multifilament filter bag.

EXAMPLE 2

A CF ink was made in accordance with the present invention using the following ingredients and the preparation procedures as set forth in Example 1.

| | Parts |
|---|---|
| Magiesol 60[1] | 29.69 |
| HRJ 10138[2] | 31.69 |
| Tri Pure R900[3] | 23.65 |
| Hydrol 710[4] | 7.88 |
| Boler 1328[5] | 3.55 |
| Neptune INI[6] | 3.55 |

[1]Technical white oil from Magie Bros. Oil Co.
[2]Phenolic resin from Schenectady Chemicals, Inc.
[3]Titanium dioxide from E. I. DuPont De Nemours & Co.
[4]$Al(OH)_3$ from Alcoa Chemical Division.
[5]Paraffin (60° C.) from Boler Petroleum Co.
[6]Micronized polyethylene from Shamrock Chemical Corp.

EXAMPLE 3

A CF ink was made in accordance with the present invention using the following ingredients and the preparation procedures as set forth in Example 1.

| | Parts |
|---|---|
| Magiesol 60[1] | 25.96 |
| HRJ 10138[2] | 25.96 |
| Kadox 15[3] | 43.80 |
| Boler 1328[4] | 1.91 |
| Neptune INI[5] | 2.39 |

[1]Technical white oil from Magie Bros. Oil Co.
[2]Phenolic resin from Schenectady Chemicals, Inc.
[3]Zinc oxide from New Jersey Zinc Co.
[4]Paraffin (60° C.) from Boler Petroleum Co.
[5]Micronized polyethylene from Shamrock Chemical Corp.

A comparative CF ink was made with the following ingredients and using the same preparation procedures as previously described. The comparative CF ink contained only 3.39 parts filler and 3.39 parts wax.

| | Parts |
|---|---|
| Magiesol 60[1] | 47.1 |
| HRJ 10138[2] | 47.1 |
| Aeriosil R972[3] | 3.39 |
| AC-655[4] | 3.39 |

[1]Technical white oil from Magie Bros. Oil Co.
[2]Phenolic resin from Schenectady Chemicals, Inc.
[3]Fumed silica from Degussa Pigments Div.
[4]"Soluble" oxidized polyethylene from Allied Chemical Corp. Plastics Div.

A transfer-litho press was loaded with the inks of Examples 1, 2, and the Comparative Example and adjusted to supply 0.94 gm/m$^2$ of the ink to a paper support web (12 lbs weight; 17×22 ream). The press was run at 600 feet per minute. The CF inks were dried using two heated dryer rolls. The rolls were heated to a surface temperature of 110° C. to set the ink.

The CF carbonless copy sheets were then tested by measuring the image density produced when these CF sheets were used to develop images made by a CB coated top sheet imaged with a 30 psi impression. A Macbeth Answer II densitometer was used for the measurements. The initial readings were taken after one hour. The samples were then conditioned, and a second reading was taken.

| Test | 140° F. Accelerated Aging[1] | 90/90 Moisture[2] |
|---|---|---|
| Example 1 | | |
| Initial | 0.39 | 0.40 |
| Final | 0.41 | 0.40 |
| % Change | +5.1 | 0.0 |
| Example 2 | | |
| Initial | 0.35 | 0.39 |
| Final | 0.40 | 0.45 |
| % Change | +14.3 | +12.5 |
| Comparative Example | | |
| Initial | 0.36 | 0.35 |
| Final | 0.33 | 0.33 |
| % Change | −8.3 | −5.7 |

[1]Form sets of CB and CF sheets were placed in a 140° F. oven under 21 lbs of weight for 2 weeks to simulate 1 year of storage at the bottom of a box.
[2]Form sets were placed in a humidity chamber at 90° F. and 90% relative humidity for 8 days.

Higher densitometer readings indicate more intense images. As can be seen, the CF sheets printed with the CF inks of the present invention produced intense images even after simulated aging and exposure to high humidity conditions. The CF sheets printed with the comparative ink showed decreases in image density after simulated aging and exposure to high humidity conditions.

It will be obvious to those skilled in the art that various changes may be made without departing from the scope of the invention which is not to be considered limited to what is described in the specification.

What is claimed is:

1. A carbonless copy sheet comprising a support sheet having two major surfaces and a coating on a first surface thereof, the coating comprising a printing ink capable of color development comprising, by weight, about 25 to 35% of a non-volatile hydrocarbon oil, 25 to 35% of an acidic color developer, 20 to 50% filler, and 4 to 15% dispersed particulate wax.

2. The carbonless copy paper sheet of claim 1 wherein said filler is selected from the group consisting of metal oxides, metal hydroxides, metal carbonates, and compatible mixtures thereof.

3. The carbonless copy sheet of claim 2 wherein said filler comprises particles having a diameter of from about 0.03 to 1.5$\mu$.

4. The carbonless copy sheet of claim 1 wherein said dispersed particulate wax is a paraffin with a melting point of about 60° to 70° C.

5. The carbonless copy sheet of claim 1 wherein said wax comprises particles having a diameter of from about 0.1 to 6$\mu$.

6. The carbonless copy sheet of claim 1 wherein said dispersed particulate dispersed wax comprises a mixture of a first wax having a melting point of between about 60° to 70° C. and a second wax having a melting point of between about 70° to 110° C.

7. The carbonless copy paper sheet of claim 1 including a second coating on a second surface thereof comprising a non-volatile diluent selected from the group consisting of methyl glucoside, dimethyl urea, dimethyl hydantoin formaldehyde resin, sorbitol, erythritol, polyoxyethylene polyols, and compatible mixtures thereof and microcapsules containing a dyestuff precursor.

8. A carbonless copy sheet comprising a support sheet having two major surfaces and a coating on the first surface thereof, the coating comprising a nonvolatile hydrocarbon oil, an acidic color developer dissolved in said non-volatile oil, a filler for adsorbing at least a portion of said non-volatile oil and color developer, and a dispersed particulate wax for fixing said non-volatile oil and color developer to the surface of a support sheet.

9. The carbonless copy sheet of claim 8 wherein said filler is selected from the group consisting of metal oxides, metal hydroxides, metal carbonates, and compatible mixtures thereof.

10. The carbonless copy sheet of claim 8 wherein said dispersed particulate wax particles have a diameter of from about 0.1 to 15$\mu$.

* * * * *

UNITED STATES PATENT AND TRADEMARK OFFICE

CERTIFICATE OF CORRECTION

PATENT NO. : 5,169,826

DATED : December 8, 1992

INVENTOR(S) : Michael E. Seitz et al

It is certified that error appears in the above-identified patent and that said Letters Patent is hereby corrected as shown below:

Co. 10, line 52, "about 0.1 to 6μ" should read --about 0.1 to 15μ--.

Signed and Sealed this

Ninth Day of November, 1993

*Attest:*

*Attesting Officer*

Bruce Lehman

BRUCE LEHMAN

*Commissioner of Patents and Trademarks*